US005582418A

United States Patent [19]

Closser

[11] Patent Number: 5,582,418

[45] Date of Patent: Dec. 10, 1996

[54] WHEEL SUSPENSION/BRAKING APPARATUS AND METHOD FOR IN-LINE ROLLER SKATES

[76] Inventor: David A. Closser, 735 17th St., Boulder, Colo. 80301

[21] Appl. No.: 408,476

[22] Filed: Mar. 21, 1995

[51] Int. Cl.[6] ..... A63C 17/06

[52] U.S. Cl. ..... 280/11.22; 280/11.2; 280/11.28

[58] Field of Search ..... 280/842, 11.19, 280/11.2, 11.22, 11.23, 11.27, 11.28, 109, 663, 677

[56] References Cited

U.S. PATENT DOCUMENTS

| | | | |
|---|---|---|---|
| 2,552,987 | 5/1951 | Loertz, Jr. | 280/11.27 |
| 2,557,331 | 6/1951 | Wintercorn | 280/11.28 |
| 2,644,692 | 7/1953 | Kahlert | 280/11.22 |
| 3,653,678 | 4/1972 | Collett | 280/11.23 |
| 3,951,422 | 4/1976 | Hornsby | 280/11.28 |
| 4,212,479 | 7/1980 | Yoshimoto | 280/11.28 |
| 4,272,090 | 6/1981 | Wheat | 280/11.22 |
| 4,351,538 | 9/1982 | Berta | 280/11.26 |
| 4,382,605 | 5/1983 | Hegna | 280/11.22 |
| 4,453,726 | 6/1984 | Ziegler | 280/11.2 |
| 4,700,958 | 10/1987 | Volpato | 280/842 |
| 5,135,244 | 8/1992 | Allison | 280/11.22 X |
| 5,342,071 | 8/1994 | Soo et al. | 280/11.22 |
| 5,405,156 | 4/1995 | Gonella | 280/11.22 X |
| 5,462,297 | 10/1995 | Lee | 280/11.22 X |
| 5,478,094 | 12/1995 | Pennestri | 280/11.22 X |
| 5,482,326 | 1/1996 | Levi | 280/677 X |

*Primary Examiner*—Brian L. Johnson

*Assistant Examiner*—Michael Mar

*Attorney, Agent, or Firm*—F. A. Sirr; E. C. Hancock; Holland & Hart llp

[57] ABSTRACT

An in-line roller skate is provided having a front bogie that supports a front pair of surface-engaging wheels and a rear bogie that supports a rear pair of surface-engaging wheels. An elongated two-member frame extends vertically down from the underside of the skate shoe and in the horizontal direction of skate movement. The lower end of a front lever-pair pivotally mounts the front bogie, and the lower end of a rear lever-pair pivotally mounts the rear bogie. The front lever-pair inclines downward toward the toe of the shoe, the rear lever-pair inclines downward toward the heel of the shoe, and a generally middle point of each lever-pair is pivoted on the two-member frame. Front and rear shock absorbing mechanisms are provided. The front shock absorbing mechanism functions between the upper end of the front lever-pair and the two-member frame, and the rear shock absorbing mechanism functions between the upper end of the rear lever-pair and the two-member frame. When a shock load is applied to one or both of the front and rear bogies, the associated shock absorbing mechanism absorbs the shock, thus minimizing the shock that is experienced by the shoe. A brake pad is adjustably mounted to the two-member frame at a location adjacent to and above the rear wheel of the rear bogie. When the shoe toe is elevated by the skater, both wheels of the rear bogie remain in physical contact with the skating surface, the rear bogie pivots relative to the rear lever-pair and relative to the shoe sole, and its rear wheel is brought into braking engagement with the brake pad.

35 Claims, 7 Drawing Sheets

50% Spring Compression
No Spring Compression
Full Spring Compression

WHEEL SUSPENSION/BRAKING APPARATUS AND METHOD FOR IN-LINE ROLLER SKATES

BACKGROUND OF THE INVENTION

1. Field of the Invention

This invention relates to the field of in-line roller skates, and more particularly to the use of front and rear bogies to independently support front and rear wheel pairs, respectively, of an in-line roller skate, the rear bogie including a selectively operable wheel braking means.

2. Description of the Related Art

The use of bogie supported wheels in an in-line roller skate is generally known. U.S. Pat. No. 4,272,090 describes a roller skate wherein the front two wheels of the skate are supported by a bogie, thus enabling the skater to lift the rear wheel, while maintaining the front two wheels in contact with the skating surface. U.S. Pat. No. 4,382,605 is also of general interest relative to the use of wheel-supporting bogies to provide a steerable vehicle, such as roller skates.

The roller skating art provides various means to absorb shock in a manner so as to minimize the shock that is transmitted to the feet of the skater. For example, U.S. Pat. No. 4,212,479 describes a roller skate having a forward inclined lever and a rear inclined lever, each lever being aligned with the direction of skating. A mid-point of each lever is pivoted to a frame that is carried below the skate shoe. The lower portion of each lever mounts a pair of laterally spaced wheels. The upper portion of each lever is connected to the frame by way of shock absorbing rubber cushion rings. U.S. Pat. No. 2,644,692 describes an in-line roller skate wherein each wheel is separately cushioned. U.S. Pat. Nos. 2,552,987, 2,557,331, 3,653,678, 3,951,422, and 4,351,538 are additional examples of the general use of some form of shock absorber in the roller skate art.

U.S. Pat. No. 5,342,071 describes an in-line skate brake assembly wherein lifting of the toe, or heel of the skate shoe, operates to bring the rear or the front skate wheel into engagement with a braking surface. U.S. Pat. No. 5,135,244 also teaches an arrangement of this general type. U.S. Pat. No. 4,453,726 teaches another arrangement for actuating a roller skate brake upon lifting the toe of the skate shoe.

While devices of the type above described are generally useful for their limited intended use, the need remains in the art for an improved wheel suspension/braking apparatus and method for in-line roller skates wherein a front bogie supports a front pair of in-line surface-engaging wheels, and a rear bogie supports a rear pair of in-line surface-engaging wheels, a shock absorbing arrangement mounts the front and rear bogies and the two pairs of in-line surface-engaging wheels under the shoe sole by way of a front facing pivoted lever and a rear facing pivoted lever, the front lever being inclined downward toward the toe of the shoe, the rear lever being inclined downward toward the heel of the shoe, and a mid point of each lever being pivoted on a frame that extends downward from the shoe sole, the lower end of the front lever mounting the front bogie, and the lower end of the rear lever mounting the rear bogie, and a shock absorbing mechanism operating between the upper end of each lever and the frame, wherein an adjustable position brake pad is mounted to the frame at a location adjacent to and above the rear wheel within the rear pair of wheels, such that when the shoe toe is selectively elevated by the user, both wheels of the rear pair of wheels remain in physical contact with the skating surface, while the rear bogie pivots relative to its lever and relative to the shoe sole, and the rear wheel is brought into braking engagement with the brake pad.

SUMMARY OF THE INVENTION

The present invention provides an in-line roller skate having a front bogie that supports a front pair of surface-engaging rollers, or wheels, and a rear bogie that supports a rear pair of surface-engaging wheels. The two bogies and the two pairs of wheels are aligned in the direction of skating so as to provide a well known in-line roller skate configuration.

A shock-absorbing mechanism is provided to mount the front and rear bogies and the associated two pairs of surface-engaging wheels under the sole of the skate shoe. More specifically, a front and a rear pivoted lever-pair are mounted under the shoe sole. The front lever-pair inclines downward toward the front, or toe of the skate shoe, the rear lever-pair inclines downward toward the rear or heel of the skate shoe, and an intermediate point of both lever-pairs is pivotally mounted on a frame that extends vertically downward from the shoe sole. The two lever-pairs and the frame are aligned in the above-mentioned direction of skating.

The lower end of the front lever-pair mounts the front bogie and the lower end of the rear lever-pair mounts the rear bogie. A shock-absorbing means, such as a pair of coiled compression springs or an elastomer member, is attached to the upper end of each of the two lever pairs. Each shock absorber operates to movably connect the upper end of its lever-pair to the frame. When a shock load is applied to one, or both, of the front and rear bogies, as by the wheels associated therewith hitting a bump or the like, the associated shock absorber operates to absorb the shock, and thus minimize shock experienced by the skate shoe.

As a feature of the invention, an adjustable-position brake pad is mounted to the frame at a location generally adjacent to and above the rear wheel of the rear bogie. When the skate shoe toe is elevated by the user, both wheels of the rear bogie remain in physical contact with the skating surface, the rear bogie pivots relative to its lever-pair, and the rear wheel thereof is brought into braking engagement with the brake pad. Manual adjustment of the brake pad accommodates wheel/pad wear.

As a feature of the invention, the four individual levers that form the two pivot lever pairs supporting the two wheel bogies are pivotally mounted on the outside of two frame walls that extend in the direction of skating, and at right angles downward from the shoe sole. This new and unusual feature of placing the pivot levers on the outside of the two frame walls ensures that sufficient space is left between the two frame walls to provide for upward vertical movement of the skate wheels and bogies. In addition, this horizontal space between the two frame walls provides for the side-by-side placement therebetween of a pair of compression coil springs for each of the two shock absorbing means. In this way, the shock absorber mechanism, or springs, are physically located between the two downward extending frame walls, and at a position relatively close to the shoe sole. Thus, the horizontal spacing between the two frame walls accommodates upward wheel/bogie movement, and provides space for mounting the shock absorbing mechanism.

As a feature of the invention, the length ratio of the two pivot arm pairs is of a preferred range wherein the length of a pivot arm from its pivot point to its lower end that supports a wheel bogie is greater than the length from its pivot point to its upper end that is connected to the shock absorbing mechanism. In an embodiment of the invention, this length ratio was in the range of from about 1.3-to-1 to about 1.9-to-1, with the overall length of a pivot arm being about 4.0 inches. Use of pivot arms of this construction provides upward, vertical movement of about 1.2 inches for the wheel bogies, as the associated shock absorber is fully compressed, this distance being about 80% of the radius of a standard skate wheel. In an embodiment of the invention, this 1.2 inch vertical wheel travel was provided with only about 0.4 to about 0.6 inch of shock absorber compression occurring.

In addition, this construction provides that the pivot arms assume an angle of about 27 degrees to the horizontal when the shock absorber is not compressed, an angle of 13 degrees to the horizontal when the shock absorber about is ½ compressed, and an angle of about zero degrees to the horizontal when the shock absorber is fully compressed.

These and other objects, advantages and features of the invention will be apparent to those of skill in the art upon reference to the following detailed description of the invention, which description makes reference to the drawing.

DESCRIPTION OF THE PREFERRED EMBODIMENT

Figure 1:
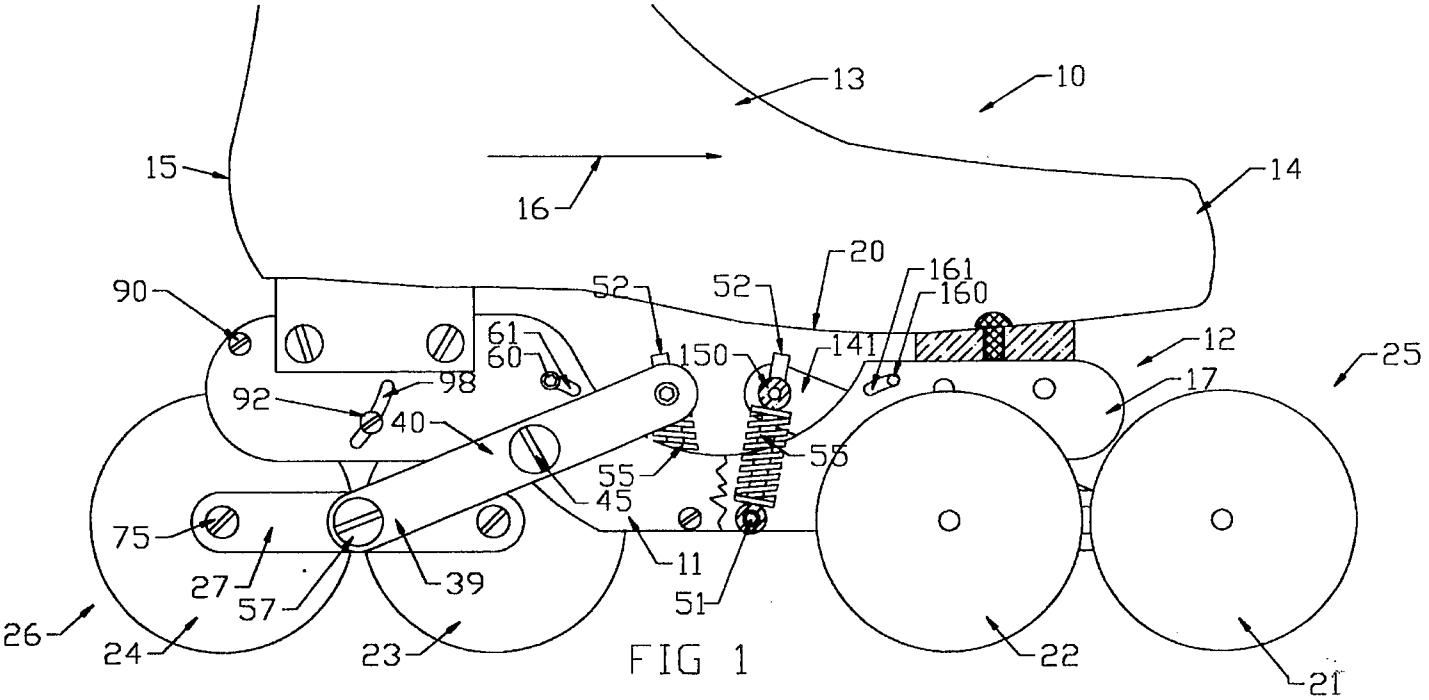
FIG. 1 is a right side view of an in-line roller skate in accordance with the present invention, wherein a front portion of the right side vertical wall of the skate's two-wall frame member has been broken away.

The present invention provides an in-line roller skate 10 having front and rear bogies 25,26 that independently support front and rear wheel pairs 21,22 and 23,24, respectively, of an in-line roller skate, the rear bogie 26 selectively cooperating with a wheel braking means 74.

The invention greatly reduces vibration that is felt by a skater, and while traditional in-line roller skates are extremely vulnerable to rocks, dips in the skating surface, manhole covers, and other such wheel obstacles, the shock absorbing bogie suspension of the present invention allows the skater to handle these obstacles with ease. Traditional in-line roller skates are also subject to uneven wheel wear, since all wheels do not at all times remain in contact with the skating surface as they do in the present invention. While hard wheels are generally preferred by skaters due to their higher speed, these wheels tend to transfer vibration to the feet of the skater. This is not true with use of the present invention wherein the shock absorbing means thereof operates to absorb vibration that is caused by the use of hard wheels. Since the invention operates to retain all wheels on the skating surface at all times, wheel wear is uniform, and thus usable wheel life is increased. Since all wheels remain in contact with the skating surface the skater's weight is at all times supported by all of the wheels, and skate speed is maximized since the skate's total rolling resistance is minimized.

While providing all of the above advantages, the present invention additionally provides for effective braking merely by way of the skater rocking back on the skate, thus elevating the toe of the skate shoe.

FIG. 1 is a right side view of an in-line roller skate 10 in accordance with the present invention, wherein a front portion of the vertical right side wall 11 of the skate's two-wall 11,17 frame member 22 has been broken away. Numeral 13 designates a skate shoe having a sole 20, toe portion 14, and a heel portion 15. The generally horizontal direction of travel of skate 10 is represented by arrow 16. As will be appreciated, the invention contemplates that each of the right-foot and left-foot skates that comprise a pair of skates is constructed in accordance with the invention.

Figure 2:
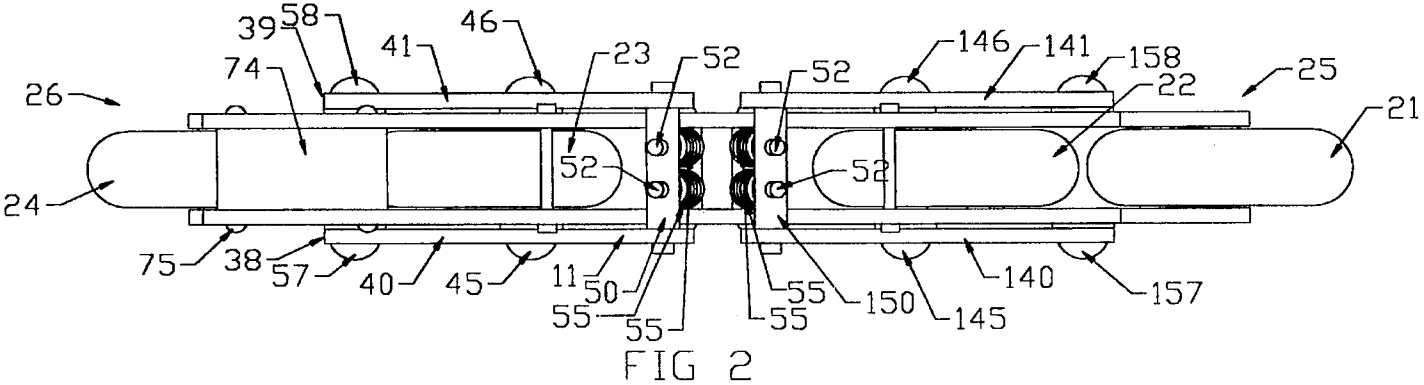
FIG. 2 is a top view of the roller skate of FIG. 1 wherein the overlying skate shoe of FIG. 1 has been eliminated for purposes of simplicity, and wherein the vertical right side wall of the skate's frame member is not broken away as it is in FIG. 1.

With reference to FIG. 2, and in accordance with the invention, frame member 12 comprises a pair of flat vertically extending, horizontally spaced, parallel, and preferably metal walls; i.e., right side wall 11 and left side wall 17, both walls of which extend in direction 16. Walls 11,17 are firmly and nonmovably attached to the bottom of the shoe's sole 20 by any suitable and well known means. As can be seen in FIG. 1, the forward or toe end of wall 11 has been broken away to better show the forward wheel 21,22 and bogie 25 structure that is housed or contained between the forward portion of the two walls 11,17.

Reference numerals 21,22 identify a front wheel pair, and reference numerals 23,24 identify a rear wheel pair, the two wheel pairs comprising a well-known 4-wheel in-line configuration that extends in direction 16. Front wheel pair 21,22 is mounted on a forward bogie 25 (only the left hand portion of which is shown in FIG. 1), and rear wheel pair 23,24 is mounted on a rear bogie 26. The two bogies 25,26 are of substantially identical construction and arrangement, with the exception that rear bogie 26 cooperates with a braking means 24, as will be described.

Figure 3:
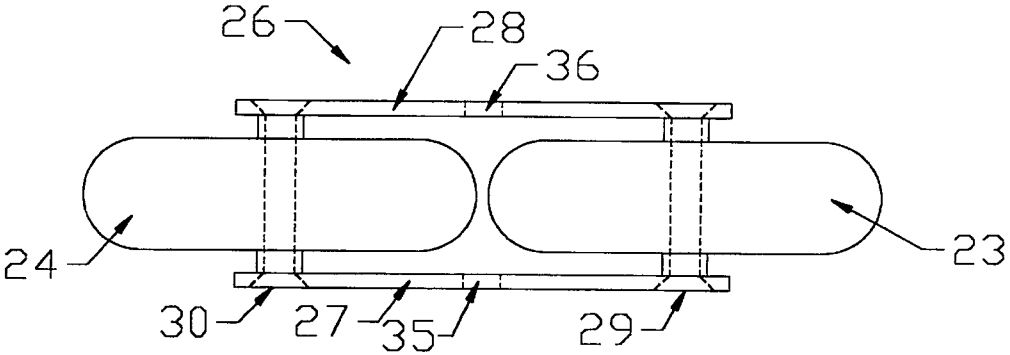
FIG. 3 is a top view of the rear one of the two identical wheel bogies that are shown in FIG. 2.

More specifically, and with reference to FIGS. 2 and 3, rear bogie 26 comprises first and second elongated, horizontally spaced, flat, parallel, and preferably metal plates 27,28 that extend in direction 16. Rear wheels 23,24 are mounted for free rotation on horizontal axles 29,30 by any number of well known and noncritical means, with axles 29,30 extending normal to direction 16. As stated, front bogie 25 is of an identical construction to that shown in FIG. 3.

Each of the two bogies 25,26 are connected to, or mounted on, frame member 12 by way of two pairs of pivot arms, one pair of pivot arms being provided for each of the two bogies 25,26. Preferably, these pivot arms comprise metal lever arms. More specifically, horizontally aligned holes 35,36 (see FIG. 3) are provided at about the longitudinal center of the two metal plates 27,28 of rear bogie 26; i.e., at about the center of gravity of rear bogie 26. Two horizontally-extending fasteners, such as bolts 57,58 shown in FIG. 2, operate to pivotally mount rear bogie 26 to the bottom ends 38,39 of the rear pivot arm pair 40,41. As will be appreciated, bogie 26 is thus mounted for free, substantially frictionless rotation about aligned and horizontally extending bolts 57,58. As seen in FIG. 1, front bogie 25 includes similar aligned and horizontally extending bolts 157,158 that operate to pivotally mount front bogie 25 to the bottom ends of its pivot arm pair 140,141. Thus front bogie 25 is mounted for free, substantially frictionless rotation about bolt pair 157,158.

Again with reference to rear bogie 26, its two pivot arms 40,41 are provided with horizontally-aligned holes that are located at an intermediate point of pivot arms 40,41. Each of these two holes receive one of a pair of horizontally aligned fasteners, such as bolts 45,46, whereby pivot arms 40,41 are mounted for free, substantially frictionless rotation on the rear portion or end of frame side walls 11,17, respectively, of frame member 12. In a similar manner, front bogie 25 and its two pivot arms 140,141 are provided with horizontally aligned holes that are located at an intermediate point of pivot arms 140,141. Each of these two holes receive one of a pair of horizontally-aligned fasteners, such as bolts 145, 146, whereby pivot arms 140,141 are mounted for free, substantially frictionless rotation on the forward portion or end of frame side walls 11,17, respectively, of frame member 12.

As will be appreciated, the four axes on which wheels 21–24 rotate, the two horizontal bogie rotation axes 57,58 and 157,158, and the two horizontal pivot arm axes 45,46 and 145,146, all extend parallel to each other, and extend normal to direction 16 shown in FIG. 1.

Rotation of the two pivot arm pairs 40,41 and 140,141 about the two horizontal axes 45,46 and 145,146, respectively, is controlled or restricted by a new and unusual shock absorbing means in accordance with the invention.

More specifically, and as best seen in FIG. 2, the upper end of each of the two parallel extending pivot arms 40,41 are interconnected by an upper disposed, horizontally extending, rigid and preferably metal rod that extends in a direction normal to direction 16. A similar upper rigid rod 150 is provided extending between the upper ends of pivot arms 140,141.

For each of the two pairs of pivot arms 40,41 and 140,141, a lower disposed rigid and preferably metal rod 51 is provided that extends between horizontally aligned lower portions of the two frame walls 11,17, as is best seen in FIG. 1. Four low surface energy plastic rods 52, preferable of the Nylon brand, are provided to movably extend between and interconnect the two rods 150, 51. Two such rods 52 are provided for each of the two pairs of rods 150,511 that are associated with each of the two pairs of pivot arm pairs 40,41 and 140,141.

Plastic rods 52 are nonmovably fixed to one or the other of the two rods 150,51, and freely slide through the other of the two rods 150,51 in a substantially frictionless manner. In this way, rotation of pivot arm pairs 40,41 and 140,141 about axes 45,46 and 145,146 is facilitated.

Figure 4:
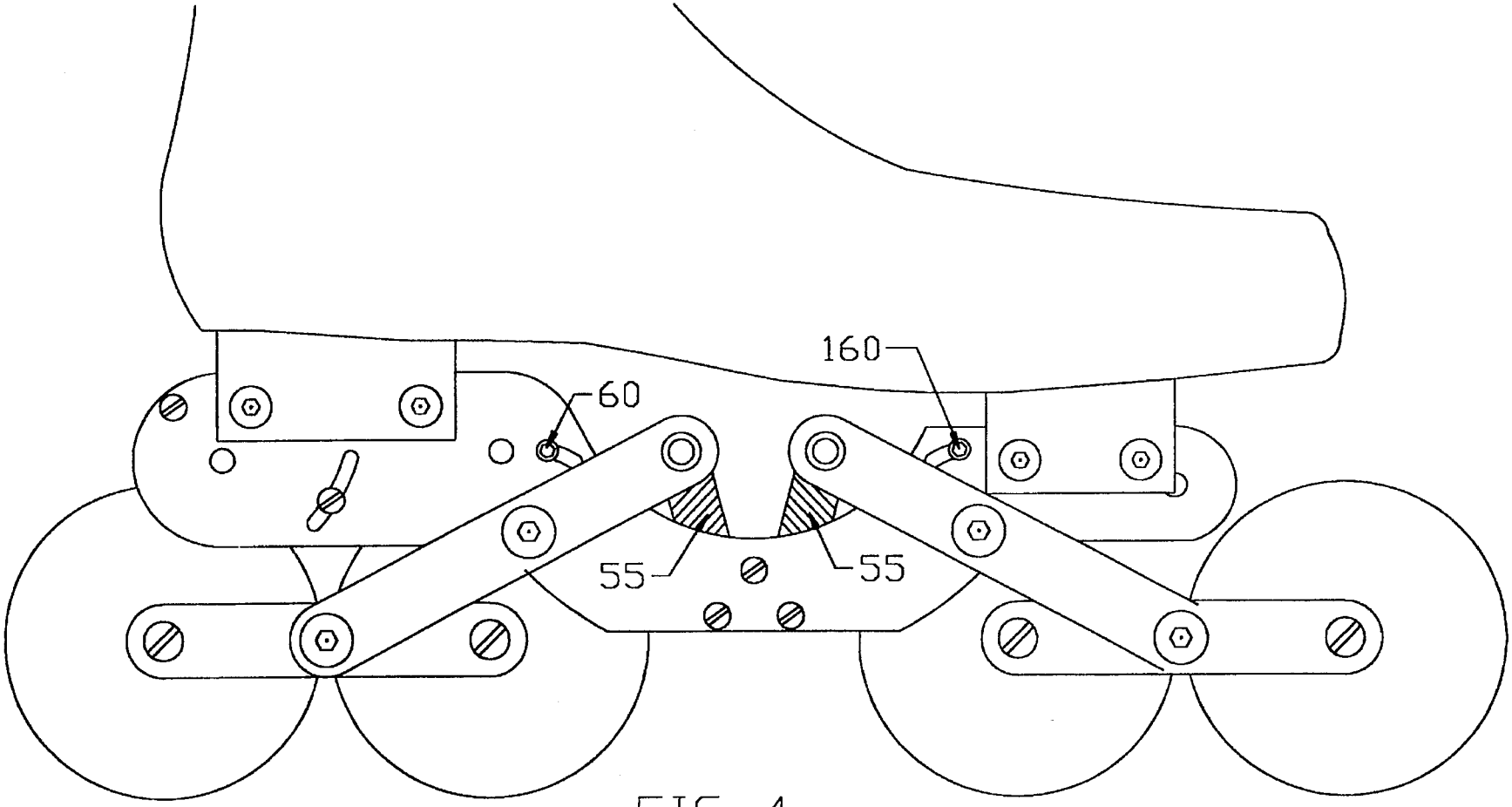
FIG. 4 shows the in-line roller skate of FIG. 1 with the compression spring shock absorbing means thereof partially compressed.
Figure 5:
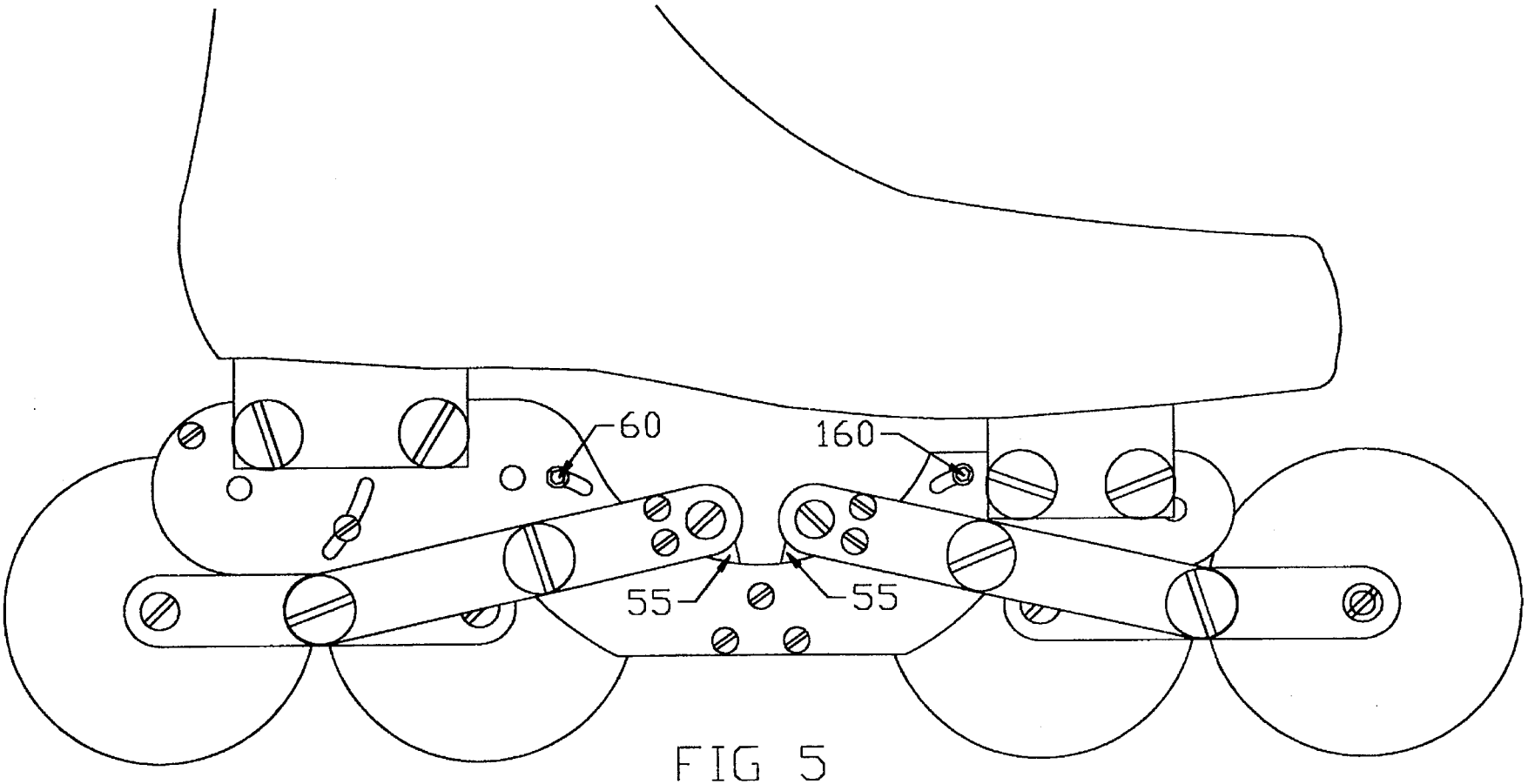
FIG. 5 shows the in-line roller skate of FIG. 1 with the compression spring shock absorbing means thereof fully compressed.

Each of the four rods 52 is surrounded by a shock absorbing means in the form of a coiled metal compression spring 55. As shown in FIGS. 4 and 5, when a shock load is applied to one or more of the skate wheels 21–24, one or both of the pivot arm pairs 40,41 and 140,141 rotate about their respective axes, to thereby partially or fully compress the associated compression springs 55 as shown in FIGS. 4 and 5, thereby absorbing the shock load and minimizing the effect upon the feet of the skater.

As a feature of the invention, a pair of manually adjustable physical stops 60,160 are carried by one or both of the two frame walls 11,17, one stop arrangement being provided for each of the two lever pairs 40,41 and 140,141. These stops 60,160 are manually adjusted in arcuate slots 61,161 so as to selectively accommodate springs 55 of different lengths for each of the two bogies 25,26. Stops 60,160 operate to physically engage levers 40,41 and 140,141 to thereby accommodate the uncompressed state of springs 55. Stops 60,160 may, for example, comprise bolts that are manually releasable so that they can be repositioned along slots 61,161 and then retightened.

Figure 6:
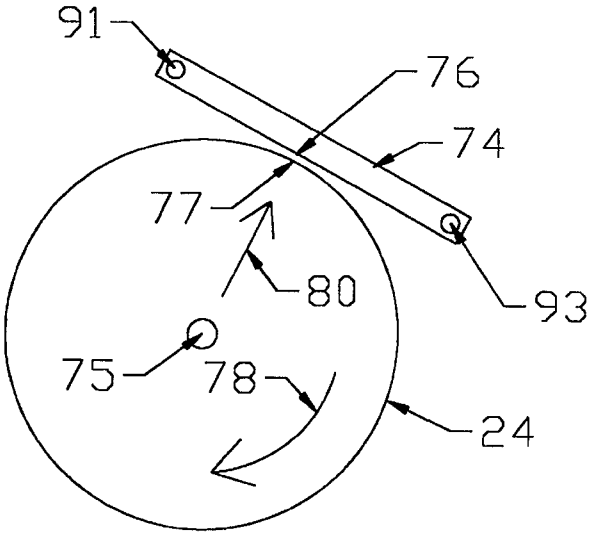
FIG. 6 is a partial exploded view showing a brake pad of the in-line skate of FIG. 1, this brake pad being selectively operable to brake rotation of the skate's rearmost wheel, and being manually adjustable to accommodate wheel/pad wear.

As a further feature of the invention, a brake pad 74 is adjustable mounted at a position between the two frame walls 11,17, and at a location that is above and somewhat forward of the axis of rotation 75 of the skate's rearmost wheel 27. As seen in FIG. 6, normally the bottom surface 76 of brake pad 74 does not physically engage the upper surface 77 of wheel 27 as wheel 27 rotates in the forward direction shown by arrow 78. However, as the skater selectively raises toe 14 of skate shoe 13, rear bogie 26 is caused to rotate in a CW direction of FIG. 1, and as a result, axis 75 of FIG. 6 moves in the direction shown by arrow 80, thus bringing wheel surface 77 into physical engagement with brake pad surface 76, thus selectively retarding rotation 78 of wheel 24.

As a feature of the invention, and with reference to FIGS. 1 and 6, brake pad 74 is mounted to frame walls 11,17 by the use of two fasteners, more specifically by way of a first fastener, such as bolt 90, that penetrates a hole 91 formed in brake pad 74, and by way of a second fastener such as bolt 92 that penetrates a second hole 93 that is formed in brake pad 74. Frame walls 11,17 are each provided with an identical and horizontally-aligned arcuate slot 98 that enable bolts 90,92 to be loosened, whereupon brake pad 74 may be rotated CW of FIGS. 1 and 6, about its hole 91, to provide for selective manual adjustment of brake pad surface 76 relative to wheel surface 77 as one or both of these surfaces wear with use.

As a feature of the invention, the above-described construction and arrangement can be retrofited to existing in-line roller skates merely by removing the wheel assemblies thereof and replacing these wheel assemblies with the construction and arrangement of the present invention.

As can be seen from the above description, the present invention provides a new, unusual and improved in-line roller skate 10 having a shock absorbing function, wherein the high quality and high performance construction and arrangement of the in-line roller skate meets or exceeds existing requirements of this industry, while at the same time providing the additional functions of shock absorption and wheel braking.

When the resilient bogie suspension of the present invention is fully compressed, the four in-line wheels 21–24 are vertically elevated, and are positioned closely adjacent to the lower horizontal surface of sole 20. In a preferred embodiment of the invention, this fully-compressed and elevated position of in-line wheels 21–24 is generally equivalent to the vertical position that the wheels occupy on in-line skates that do not incorporate the present invention. Thus, in-line skates incorporating the present invention visually appear quite similar to state of the art skates, and the skater's foot is generally positioned the same familiar vertical distance above a skating surface. In an embodiment of the invention, the total vertical motion of wheels 21–24 was about 1.2 inches. Thus, in smooth surface skating condition when the shock absorbing mechanism of the invention is about ½ compressed by the weight of the skater, the skater's foot is only about 0.6 inches higher above the skating surface than it is with a conventional in-line roller skate.

The majority of the recreational in-line roller skates have four in-line wheels. Racing in-line skates generally have five in-line wheels, thus making these skates somewhat less maneuverable. While the spirit and scope of the present invention need not be limited thereto, a preferred embodiment of the invention provides four in-line wheels 21–24 that are resiliently supported for vertical movement by two in-line bogies 25,26, two wheels being provided per bogie, thus rendering in-line skates in accordance with the invention visually similar to standard recreational in-line skates.

An important feature of the present invention is to resiliently support wheel bogies 25,26 for vertical shock absorbing movement, while at the same time retaining the same lateral stiffness and tightness of wheel suspension that is provided by standard in-line skates. At the same time, the wheel suspension of this invention provides sufficient smooth and non-binding vertical travel of the bogies/wheels to adequately protect the skate's feet from shock.

Another important feature of this invention is to provide the various functions and advantages thereof without providing a structure that is likely to engage or scrape the skating surface when the skater's foot tilts to the side at an extreme angle. With the skater standing upright and generally motionless or moving slowly, the plane of sole 20 is generally horizontal and parallel to the skating surface. When skating normally, this sole-to-horizontal angle often becomes as low as 45 degrees, and perhaps as low as 30 to 35 degrees when skating aggressively. The structure and arrangement of the present invention provides a horizontally narrow wall 11,17 construction enabling these angles of sole tilt to be achieved without any portion of the in-line skate scraping the skating surface. That is, frame walls 11,17 are spaced horizontally apart only so far as is required to accommodate vertical movement of wheels 21–24 and to accommodate placement of two shock absorbing means.

In order to provide physical space for the shock absorbing suspension of the invention to fully compress, thus allowing wheels 21–24 to vertically rise and almost touch the bottom of shoe sole 20, but without dramatically increasing the overall length of the skate's horizontal wheelbase between front wheel 21 and rear wheel 24, the four pivot levers 40,41,140,141 that form the two pivot lever pairs supporting the two bogies 25,26 are pivotally mounted on the outside surface of the two frame walls 11,17 that extend in the direction 16 of skating, and that extend down from and at right angles to sole 20. This new and unusual feature of placing levers 40,41,140,141 on the outside of frame walls 11,17 ensures that only sufficient horizontal space is left between walls 11,17 to provide for vertical movement of wheels 21–24. In addition, this horizontal space between frame walls 11,17 provides sufficient space for the side-by-side placement of two compression coil springs 55 for each of the two shock absorbing means.

Each of the pivot arm or lever pairs 40,41 and 140,141 comprise two similar shaped, rigid, horizontally spaced, and parallel extending arms. Considering rear pivot arms 40,41 of FIGS. 1 and 2, the lower end of the two parallel arms 40,41 are coupled as a rigid unit to the rear two-wheel bogie 26. A horizontally-aligned intermediate portion of each arm 40,41 is pivoted at similar horizontally aligned positions on the two frame walls 11,17, to thereby define a common horizontal pivot axis 57,58 for the two arms 40,41. The upper end of each arm 41,41 is coupled as a rigid unit to a shock absorbing mechanism that connects the upper ends thereof to horizontally aligned positions 51 on the two frame walls 11,17.

As a result, each of the rigid two-arm structures 40,41 and 140,141 that is provided for the two bogies 25,26 is supported to pivot as a single rigid unit about a common horizontal axis 57,58 and 157,158 that is defined on frame walls 11,17, as the wheels 21,22 and 23,24 that are carried at the lower ends thereof engage the skating surface. The effect is to resiliently support each of the two-wheel bogies 25,26 on frame 12 by means of the equivalent of a single rigid pivot arm.

An important feature of the structure above described, is that the shock absorber mechanism or springs are physically located between the two downward extending frame walls 11,17, and at a position relatively close to sole 20. Thus, the horizontal spacing between the two frame walls 11,17 is minimized while accommodating upward wheel/bogie movement and providing space for mounting the shock absorbing mechanism.

More specifically, upper ends of pivot arms 40,41 and 140,141 cooperate with two shock absorbing spring mechanisms or elastomer members that are physically located between the two downward extending frame walls 11,17. The upper end of each of the two shock absorbing structures is secured to the upper ends of the two arms 40,41 and 140,141 by way of a horizontally-extending pin 50,150, or perhaps and equivalent plate as in FIGS. 8–10, and the lower end of the two shock absorbing structures are each secured to or supported by a horizontally extending pin 51 that extends between the two downward extending frame walls 11,17.

In order to minimize the physical space that is occupied by a shock absorber of the coiled spring type, and in order to keep the skate's horizontal wheel base relatively short, in an embodiment of the invention two small diameter, vertically inclined, parallel and side-by-side ⅝ or 1.0 inch diameter coil springs 55 were used within each of the two shock absorbing mechanisms. In this two-spring embodiment of the invention the length of each spring when not compressed was about 1.75 inches, the spring length was about 85% of this length when ½ compressed, and the spring length was about 70% of this length when fully compressed.

This construction provides the effect of a single unitary shock absorbing structure acting on each bogie 25,26.

As a feature of the invention, the length ratio of the two above-mentioned pivot arm pairs 40,41 and 140,141 is of a preferred range.

Figure 7:
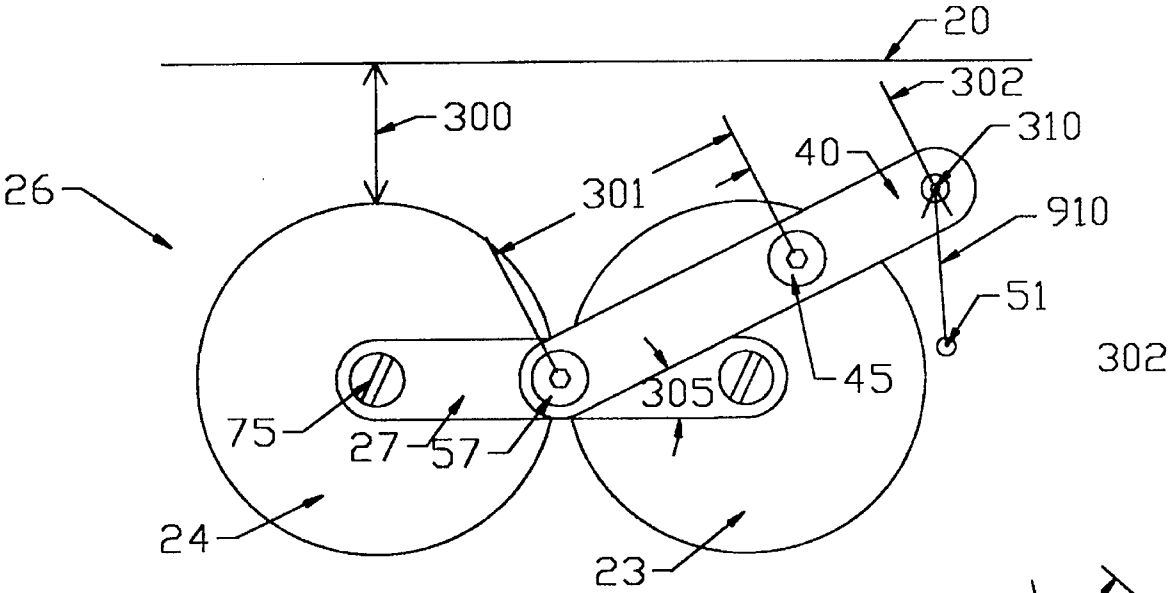
FIG. 7 is a right side view of the rear wheel bogie of FIG. 1 and is an example of a preferred construction of the two pivot arm pairs that support the front and rear wheel bogies.

With reference to FIG. 7, which figure shows the right side view of rear bogie 26 and is an example of a preferred construction of all four pivot arms 40,41,140,141, the length 301 of pivot arm 40 from its pivot point 45 to its lower end 57 that supports rear bogie 26 is greater than the length 302 of arm 40 from pivot point 45 to the upper end 50 thereof that is connected to the above described shock absorbing mechanism. In an embodiment of the invention, this length ratio of 301-to-302 was in the range of from about 1.3-to-1 to about 1.9-to-1, with the overall length of arm 40 being about 4.0 inches. Use of pivot arms 40,41,140,141 of this construction provides vertical movement 300 of about 1.2 inches of wheel bogies 25,26 upward toward shoe sole 20, as the associated shock absorber is fully compressed, this distance 300 being about 80% of the radius of a standard skate wheel. In an embodiment of the invention, this 1.2 inch vertical wheel travel 300 was provided with only about 0.4 to about 0.6 inch of shock absorber spring compression occurring.

In addition, this construction provides that pivot arms 40,41,140,141 assume an angle 305 of about 27 degrees to the horizontal when the shock absorber is not compressed, about an angle 305 of 13 degrees to the horizontal when the shock absorber is about ½ compressed, and about an angle 305 of about zero degrees to the horizontal when the shock absorber is fully compressed. In an embodiment of the invention designed for a 170 pound skater, this angle 305 to the horizontal was about 13 degrees when the skater was standing still on the skates.

Using FIG. 3 as an example, the two above-described bogies 25,26 each comprise two horizontally extending, horizontally spaced, and parallel metal arms 27,28. The general midpoint of each bogie arm 27,28 is pivotally mounted on a common horizontal axis 35,36 to the lower end of one of the two above described pivot arms. The front end and the rear end of the two bogie arms 27,28 each mount a horizontally extending and parallel axle 29,30 for an in-line wheel 23,24. While not critical to the invention, in an embodiment of the invention the overall horizontal length of the bogie arms 27,28 was about 4 inches.

As a feature of the invention, front bogie 25 may be constructed so as to mount front wheel 21 a greater distance from bogie arm pivot 157,158 than rear wheel 22 is mounted from pivot 157,158.

Figure 8:
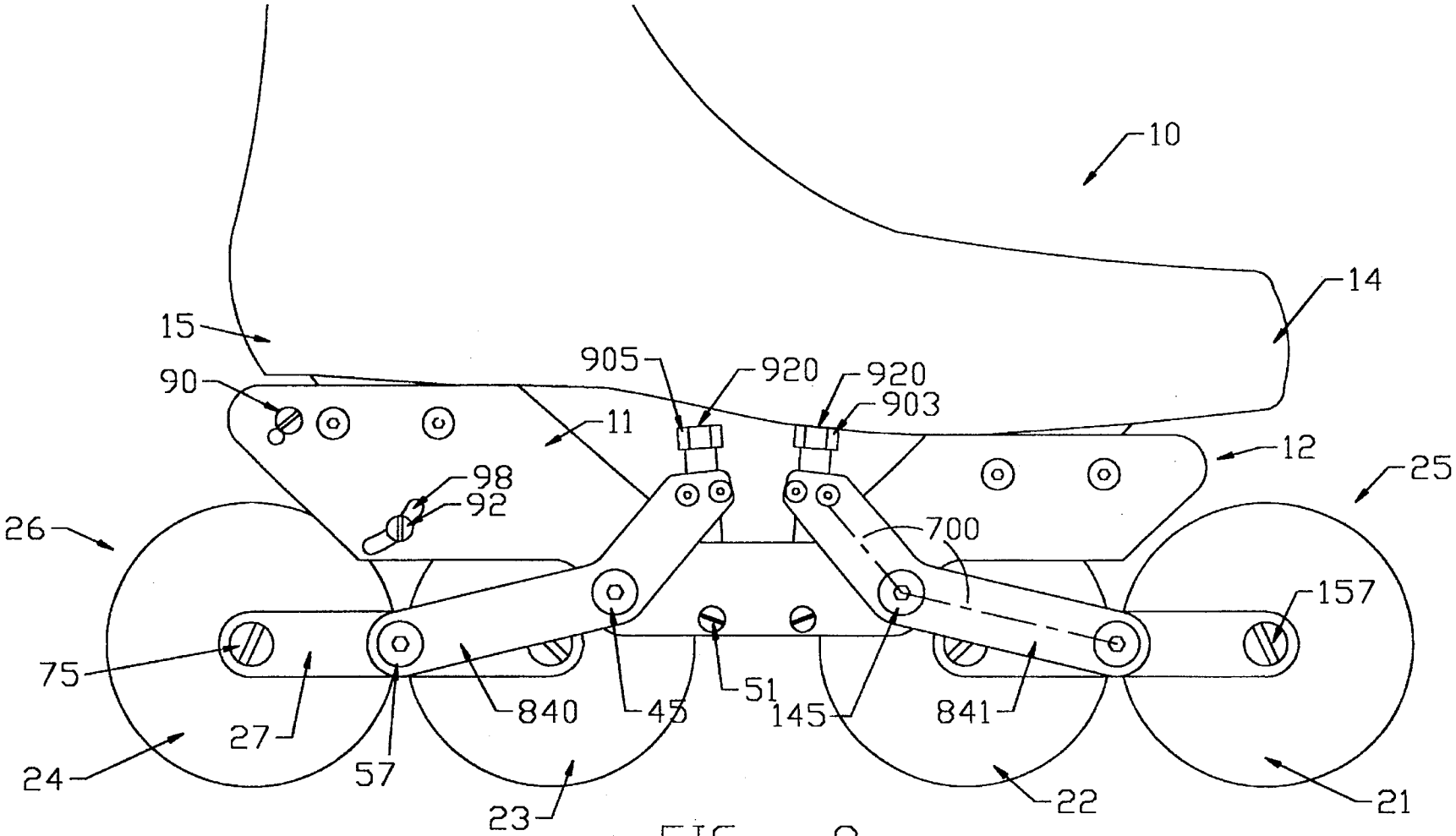
FIG. 8 is a right side view of another embodiment of an in-line roller skate in accordance with the present invention wherein the adjustable stops for the pivot arms of FIG. 1 have been eliminated, and wherein the function of these stops has been replaced by the use of threaded rods that run through the center of the shock absorber springs, these rods having top-disposed nuts whose adjustment both limits rotation of the pivot arms and facilitates use of different length springs this embodiment of the invention also providing bent lever arms.

FIG. 8 is a right side view of another embodiment of an in-line roller skate 10 in accordance with the present invention, wherein the adjustable stops 60,160 for pivot arms 40,41,140,141 of FIG. 1 have been eliminated, and wherein the function of stops 60,160 has been replaced by the use of four threaded rods 920 that run axially through the center of the four shock absorber springs 910. Each of the four threaded rods 920 has a top-disposed manually-adjustable nut 902–905 whose adjustment both limits rotation of the four pivot arms, and also facilitates the use of different axial length springs 910.

As can also be seen from FIG. 8, the top portions of the four pivot arms that support front bogie 25 and rear bogie 26 are each bent upward beginning at the point at which the arms pivot on a downward extending vertical wall of frame member 12, for example, forming an angle 700 of about 143 degrees. As will be appreciated by those of skill in the art, depending upon the selected details of design in accordance with this invention, angle 700 can vary from about 90 to about 180 degrees.

In FIG. 8, only right-hand frame wall 11 is shown, along with the pivot points 45 and 145 for pivot arms 840 and 841, this being the means whereby pivot arms 840 and 841 are pivotally mounted onto frame wall 11. The use of bent pivot arms as shown in this embodiment provides for the use of softer springs 910, while still providing the same degree of shock absorption. In addition, with the use of bent pivot arms, the angle that the four shock absorbing springs make to the horizontal advantageously remains substantially the same for both the condition of no spring compression and the condition of full spring compression.

Figure 9:
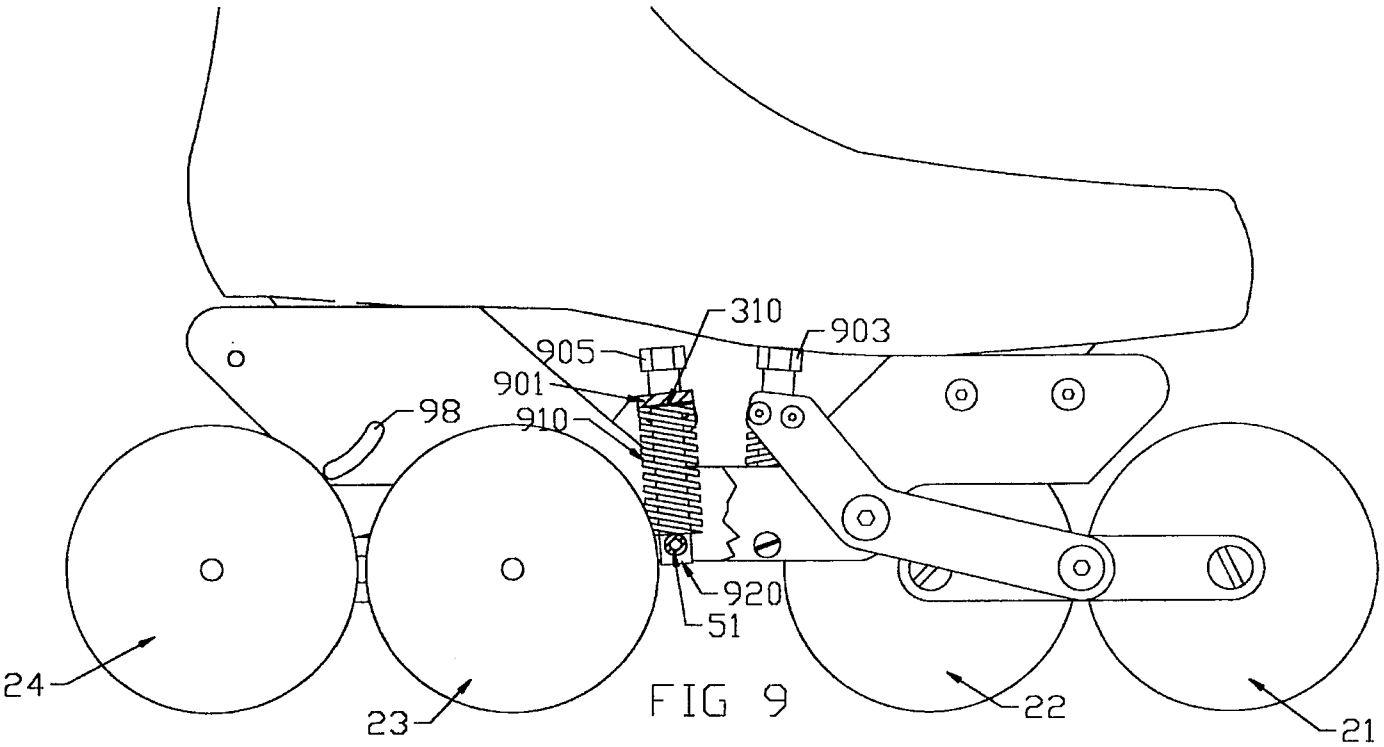
FIG. 9 is a view similar to FIG. 8 wherein a rear portion of the right side vertical wall of the skate's two-wall frame member has been broken away.

FIG. 9 is a view similar to FIG. 8 wherein a rear portion of the right side vertical wall 11 of the skate's two-wall frame member 12 has been broken away.

Figure 10:
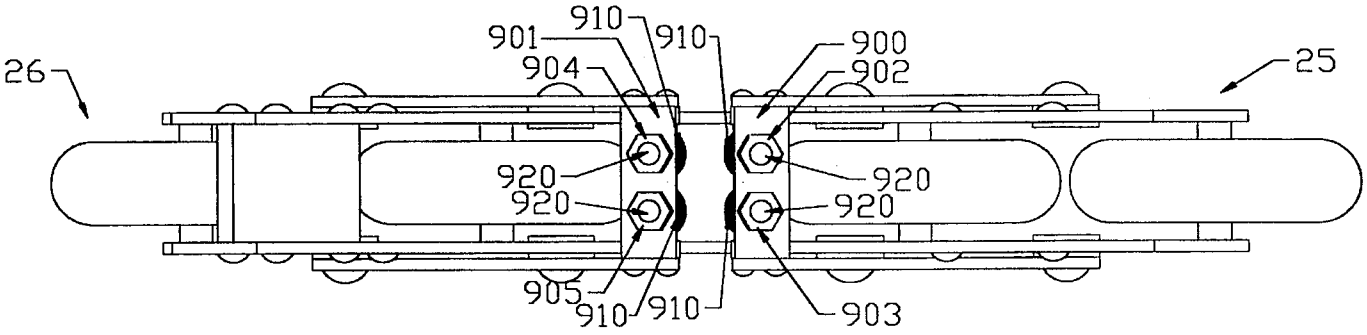
FIG. 10 is a top view of the roller skate of FIG. 8 wherein the overlying skate shoe of FIG. 8 has been eliminated for purposes of simplicity, and wherein the vertical right side wall of the skate's frame member is not broken away as it is in FIG. 9.

FIG. 10 is a top view of the roller skate of FIG. 8 wherein the overlying skate shoe of FIG. 8 has been eliminated for purposes of simplicity, and wherein the vertical right side wall 11 of the skate's frame member 12 is not broken away as it is in FIG. 9. FIGS. 9 and 10 better show the arrangement of the four center rods 920 and the four coil springs 910.

It will be noted that in this embodiment of the invention, two top-disposed plates 900,901 are provided through which threaded rods 920 freely pass, rather than using the two similar functioning top-disposed rods 50,150 as in the embodiment of FIG. 1. As can be seen in FIG. 9, each one of the four springs 910 is compressed between a top-disposed plate 900,901 and a bottom-disposed rod 50,150, the uncompressed distance between the spring's top plate 900,901 and its rod 51 being a function of the position of the spring's top-disposed nut 902–905 along its axially-disposed rod 920.

Figure 11:
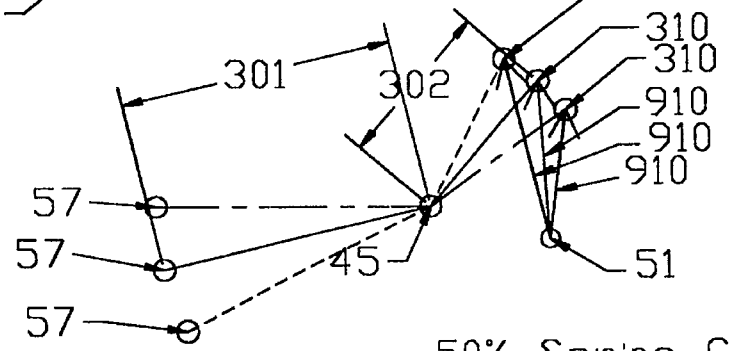
FIG. 11 is a side diagrammatic view of the arrangement of FIG. 7 and is an example of a preferred construction of the two pivot arm pairs that support the front and rear wheel bogies.

FIG. 11 is a side diagrammatic view of the pivot arm arrangement of the invention, and showing the use of the bent pivot arms of FIGS. 8–10, this being an example of a preferred construction of the two pivot arm pairs that support the front and rear wheel bogies. In FIG. 11, three different pivoted positions of the bent pivot arm 840 of FIGS. 8–10 are shown; namely, solid lines show the arm position in a 50% spring compression state, dashed lines show the arm position in a spring uncompressed state, and broken lines show the arm position in a spring fully compressed state, as these three positions are indicated on this figure.

In addition, FIG. 11 shows three force vector arrows that depict the three different upward direction spring forces (see springs 910 of FIG. 10) that correspond to each of the above-mentioned three different arm positions. In FIG. 11, reference numeral 310 identifies the point of contact of compression springs 910 with the plate 900 that connects the two side disposed pivot arms.

By way of a general description of the parameters of the present invention relative to both the straight arm configuration of FIG. 7 and the bent arm configuration of FIGS. 8–10, and with reference to FIG. 7, if the ratio of pivot arms lengths 301-to-302 was 1-to-1, and the angle between points 45,310,51 was selected to be about 90 degrees, then for every 1 inch of wheel travel 300, about 1 inch of spring travel would be required. When the angle between points 45,310,51 is reduced, then less spring travel is required for the same 1 inch wheel travel 300. A preferred angle 45,310,51 is in the range of from about 41 to about 48 degrees. However, a range of from about 30 to about 90 degrees is considered to be within the spirit and scope of this invention. In a preferred embodiment of the invention, the magnitude of angle 45,310,51 was reduced by using a bent pivot arm of FIGS. 8–10, and by moving the lower end of the compression springs close to the arm's point 45.

While the invention has been described in detail while making reference to preferred embodiments thereof, it is appreciated that those skilled in the art will readily visualize yet other embodiments that are within the spirit and scope of the invention. Thus this detailed description is not to be taken as a limitation on the spirit and scope of the invention.

What is claimed is:

1. In an in-line roller skate adapted to move in a travel direction relative to a skating surface, the skate having a skate shoe with a toe portion, a heel portion and a generally horizontally extending sole, the improvement comprising;

a front and a rear wheel-supporting bogie, each bogie having an elongated and generally horizontally extending wheel support member having a front end, a rear end, and an intermediate portion, each wheel support member supporting a wheel at the front and rear ends thereof, said wheels being supported on axes of rotation that extend generally horizontal and normal to said travel direction, front and rear elongated and inclined lever means associated with said front and rear bogie, respectively, each of said front and rear lever means having an upper portion, a lower portion, and an intermediate portion, means pivotally mounting said intermediate portion of said front and rear lever means at horizontally spaced and fixed positions relative to said toe portion and said heel portion, respectively, said front and rear lever means being spaced in said travel direction, means pivotally mounting said intermediate portion of said front bogie wheel support member on said lower end of said front lever means, means pivotally mounting said intermediate portion of said rear bogie wheel support member on said lower end of said rear lever means, front shock absorbing means operable between said upper portion of said front lever means and said sole, and rear shock absorbing means operable between said upper portion of said rear lever means and said sole.

2. The in-line roller skate of claim 1, including;

brake pad means mounted at a position intermediate said heel portion and a rear wheel of said rear bogie, said rear wheel begin normally out of physical engagement with said brake pad means, and said rear wheel being movable into physical engagement with said brake pad means upon elevation of said toe portion.

3. The in-line roller skate of claim 1 wherein said front and rear shock absorbing means comprise front and rear coiled compression spring means, respectively, each of said front and rear coiled compression spring means having a coiled length, and including;

front and rear manually adjustable stop means associated with the upper portions of said front and rear lever means, respectively, said front and rear stop means operating to restrict movement of said upper portions of said front and rear lever means, respectively, when said front and rear coiled compression means are in an uncompressed state, and said front and rear stop means facilitating the use of front and rear coiled compression spring means of variable coil length in accordance with the manual adjustment said front and rear stop means.

4. The in-line roller skate of claim 3, including;

brake pad means mounted at a normally fixed position that is intermediate said sole and a rear wheel of said rear bogie, said rear wheel begin normally out of physical engagement with said brake pad means, and said rear wheel being movable into physical engagement with said brake pad means upon elevation of said toe portion, and manual adjustment means for said brake pad to facilitate selective manual adjustment of said normally fixed position as said brake pad and/or rear wheel wears.

5. An in-line roller skate adapted to move in a travel direction relative to a generally horizontal skating surface, comprising;

a skate shoe having a generally horizontal sole, a heel and a toe that is a forward portion of said shoe in said travel direction, first and second parallel side wall members extending vertically down from said sole, said first and second wall members being horizontally spaced apart and extending in said travel direction, a front wheel supporting bogie having a generally horizontal and elongated support member, said support member having a front portion that supports a first wheel, a rear portion that supports a second wheel, and a mid-portion, a rear wheel supporting bogie having a generally horizontal and elongated support member, said support member having a front portion that supports a third wheel, a rear portion that supports a fourth wheel, and a mid-portion, said first, second, third and fourth wheels being supported in-line in said travel direction on first, second, third and fourth axes, respectively, that extend generally horizontal and normal to said travel direction, front forward inclined lever means, said front lever means having a lower portion rotatably connected to said mid-portion of said front bogie support member, and having an upper portion and an intermediate portion, rear rearward-inclined lever means, said rear lever means having a lower portion rotatably connected to said mid-portion of said rear bogie support member, and having an upper portion and an intermediate portion, said front and rear bogie support members being supported in-line in said travel direction on fifth and sixth axes, respectively, that extend generally horizontal and normal to said travel direction, first means pivotally mounting said intermediate portion of said front lever means to said first and second wall members at a location generally under said toe and on a seventh axis that extends generally normal to said travel direction, second means pivotally mounting said intermediate portion of said rear lever means to said first and second wall members at a location that is generally under said heel and on an eighth axis that extends generally normal to said travel direction, front shock absorbing means operating between said upper portion of said front lever means and said first and second wall members, and rear shock absorbing means operating between said upper portion of said rear lever means and said first and second wall members.

6. The in-line roller skate of claim 5, including;

manually adjustable brake pad means mounted between said first and second wall members at a position that is generally vertically above said fourth wheel, said fourth wheel being normally out of engagement with said brake pad means, and said fourth wheel being movable into engagement with said brake pad means upon elevation of said toe.

7. The in-line roller skate of claim 5;

wherein said front shock absorbing means comprises front coiled compression spring means having a coil length that is compressed between said upper portion of said front lever means and attachment to said first and second wall members, wherein said rear shock absorbing means comprises rear coiled compression spring means having a coil length that is compressed between said upper portion of said rear lever means and attachment to said first and second wall members, including;

front and rear manually adjustable stop means associated with said upper portions of said front and rear lever means, respectively, and said front and rear stop means being adjustable to facilitate use of variable coil length first and second compression spring means.

8. The in-line roller skate of claim 7;

wherein said first and second lever means each include a lower arm that extends between said intermediate portion and said lower portion, and an upper arm that extends between said intermediate portion and said upper portion, and wherein said upper arms of said first and second lever means are bent at equal angles out of alignment with said lower arms and upward toward said sole.

9. A method providing shock absorption for an in-line roller skate that is adapted to move in a travel direction relative to a skating surface, the skate having a shoe with a toe portion, a heel portion and a generally horizontally extending sole extending between said toe and heel portions, the method comprising the steps of;

providing a front and a rear wheel-supporting bogie, each bogie having a generally elongated and horizontally extending wheel support member having a front portion, a rear portion, and a mid-portion, each wheel support member supporting a pair of in-line wheels, the two wheels that comprise a pair of wheels being located on said front and rear portions of said wheel support member, said two wheels that comprise a pair of wheels being supported on said wheel support member on two axes of rotation that extend generally horizontal and normal to said travel direction, providing front and rear pivoted, elongated, and inclined lever means associated with said front and rear bogie, respectively, each of said front and rear lever means having an upper portion, a lower portion, and an intermediate portion, providing means pivotally mounting said intermediate portion of said front and rear lever means at spaced positions beneath said toe portion and said heel portion, respectively, providing means pivotally mounting said mid-portion of said front bogie wheel support member on said lower end of said front lever means, providing means pivotally mounting said mid-portion of said rear bogie wheel support member on said lower end of said rear lever means, providing front shock absorbing means operating between said upper portion of said front lever means and said sole, and providing rear shock absorbing means operating between said upper portion of said rear lever means and said sole.

10. The method of claim 9, including the step of;

providing brake pad means at a position intermediate said sole and a rear wheel of said rear bogie, said rear wheel being normally out of physical engagement with said brake pad means, and said rear wheel being movable into physical engagement with said brake pad means upon elevation of said toe portion.

11. The method of claim 9 wherein said front and rear shock absorbing means comprise front and rear coiled compression spring means, respectively, each of said front and rear coiled compression spring means having a coiled length, and including the step of;

providing front and rear manually adjustable stop means associated with the upper portions of said front and rear lever means, respectively, said front and rear stop means operating to restrict movement of said upper portions of said front and rear lever means, respectively, when said front and rear coiled compression means are in an uncompressed state, said front and rear stop means facilitate the use of front and rear coiled compression spring means of variable coil length in accordance with the manual adjustment thereof.

12. The method of claim 11, including the steps of;

providing brake pad means mounted at a normally fixed position that is intermediate said sole and a rear wheel of said rear bogie, said rear wheel being normally out of physical engagement with said brake pad means, and said rear wheel being movable into physical engagement with said brake pad means upon elevation of said shoe toe portion, and providing manual adjustment means for said brake pad means to facilitate selective manual adjustment of said normally fixed position as said brake pad means and/or rear wheel wear.

13. A method of retrofitting an in-line roller skate having a plurality of in-line wheels to providing wheel shock absorption, comprising the steps of;

removing said plurality of in-line wheels from said roller skate, providing a front and a rear wheel-supporting bogie, each bogie having a generally horizontal and elongated wheel support member with a front portion, a rear portion, and a mid-portion, each wheel support member supporting a pair of in-line wheels, the two wheels that comprise a pair of wheels being located on said front and rear portions of said wheel support member, said two wheels that comprise a pair of wheels being supported on said wheel support member on two parallel and generally horizontal axes of rotation, providing front and rear pivoted, elongated, and inclined lever means associated with said front and rear bogie, respectively, each of said front and rear lever means having an upper portion, a lower portion, and an intermediate portion, providing means pivotally mounting said intermediate portion of said front and rear lever means at spaced positions relative to said toe portion and said heel portion, respectively, providing means pivotally mounting said mid-portion of said front bogie elongated wheel support member on said lower end of said front lever means, providing means pivotally mounting said mid-portion of said rear bogie elongated wheel support member on said lower end of said rear lever means, providing front shock absorbing means operating between said upper portion of said front lever means and said sole, and providing rear shock absorbing means operating between said upper portion of said rear lever means and said sole.

14. The method of claim 13, including the step of;

providing brake pad means at a position that is vertically intermediate said sole and a rear wheel of said rear bogie, said rear wheel being normally out of physical engagement with said brake pad means, and said rear wheel being movable into physical engagement with said brake pad means upon elevation of said toe portion.

15. The method of claim 14 wherein said front and rear shock absorbing means comprise front and rear coiled spring means, respectively, each of said front and rear coiled spring means having a coiled length, and including the step of;

providing front and rear manually adjustable stop means associated with the upper portions of said front and rear lever means, respectively, said front and rear stop means operating to restrict movement of said upper portions of said front and rear lever means, respectively, as said front and rear coiled spring means are in an uncompressed state, said front and rear stop means facilitate the use of front and rear coiled spring means of variable coil length in accordance with the manual adjustment thereof.

16. The method of claim 15, including the steps of;

providing brake pad means mounted at a normally fixed position that is intermediate said sole and a rear wheel of said rear bogie, said rear wheel begin normally out of physical engagement with said brake pad means, and said rear wheel being movable into physical engagement with said brake pad means upon elevation of said shoe toe portion, and providing manual adjustment means for said brake pad means to facilitate selective manual adjustment of said normally fixed position as said brake pad means and/or rear wheel wear.

17. An in-line roller skate adapted to move in a travel direction relative to a skating surface, comprising;

a skate shoe having a toe portion, a heel portion and a generally horizontally extending sole, a front and a rear wheel-supporting bogie, each bogie having an elongated and generally horizontally extending wheel support member having a front end that rotationally supports a first wheel, a rear end that rotationally supports a second wheel, and an intermediate portion, front and rear elongated and inclined lever means associated with said front and rear bogie, respectively, each of said front and rear lever means having a bottom end, a top end, and an intermediate portion, each of said front and rear lever means having a lower portion that extends from said bottom end to said intermediate portion, each of said front and rear lever means having an upper portion that extends from said intermediate portion to said top end, said upper and lower portions of each of said front and rear lever means having a length ratio in the range of from about 1.3-to-1 to about 1.9-to-1, means pivotally mounting said intermediate portion of said front and rear lever means at horizontally spaced and fixed positions vertically under said toe and heel portions, respectively, means pivotally mounting said intermediate portion of said front bogie wheel support member on said bottom end of said front lever means, means pivotally mounting said intermediate portion of said rear bogie wheel support member on said bottom end of said rear lever means, front shock absorbing means operable between said top end of said front lever means and said sole, and rear shock absorbing means operable between said top end of said rear lever means and said sole.

18. The in-line roller skate of claim 17, including;

brake pad means mounted at a position that is vertically intermediate said heel portion and said second wheel of said rear bogie, said second wheel being normally out of physical engagement with said brake pad means, and said second wheel being movable into braking engagement with said brake pad means upon elevation of said toe portion.

19. The in-line roller skate of claim 17 wherein said front and rear shock absorbing means comprise front and rear coiled compression spring means, respectively, wherein each of said front and rear coiled spring means have a coiled length, and including;

front and rear manually adjustable s/top means associated with said upper portions of said front and rear lever means, respectively, said front and rear stop means operating to restrict movement of said upper portions of said front and rear lever means, respectively, when said front and rear coiled spring means are in an uncompressed state.

20. The in-line roller skate of claim 19, including;

brake pad means mounted at a normally fixed position that is vertically intermediate said hole and said second wheel of said rear bogie, said second wheel being normally out of physical engagement with said brake pad means, and said second wheel being movable into physical engagement with said brake pad means upon elevation of said toe portion, and manual adjustment means for said brake pad to facilitate selective manual adjustment of said normally fixed position of said brake pad means.

21. The in-line roller skate of claim 17 wherein the length of each of said front and rear lever means is about 4.0 inches, and wherein a range of vertical movement of said front and rear bogies upward toward said sole is about 80% of a wheel radius.

22. The in-line roller skate of claim 21 wherein;

said front and rear lever means form an angle of about 27 degrees to said sole when said front and rear shock absorber means are not subjected to a shock, said front and rear lever means form and angle of about 13 degrees to said sole when said front and rear shock absorber means are subjected to a shock that is about mid-range of the ability of said shock absorbing means to absorb a shock, and said front and rear lever means form and angle about zero degrees to said sole when said front and rear shock absorber means are subjected to a shock that is about full-range of the ability of said shock absorbing means to absorb a shock.

23. The in-line roller skate of claim 22 wherein;

the horizontal length of said wheel support member of each of said front and rear bogies is about 4 inches.

24. An in-line roller skate adapted to move in a travel direction relative to a generally horizontal skating surface, comprising;

a skate shoe having a generally horizontally extending sole, a heel and a toe, said toe comprising a forward direction of said shoe relative to said travel direction, first and second elongated and parallel side wall members extending vertically downward from said sole, said first and second wall members being horizontally spaced apart and extending in said forward direction, said first and second wall members each having an internal surface and an external surface, said internal surfaces of said first and second wall members facing each other and being horizontally spaced apart, a front bogie having a generally horizontal and elongated support member, said support member having a front portion supporting a first wheel, having a rear portion supporting a second wheel, and having a mid-portion, a rear bogie having a generally horizontal and elongated support member, said elongated support member having a front portion supporting a third wheel, having a rear portion supporting a fourth wheel, and having a mid-portion, front pivoted lever means inclined downward in said forward direction, said front lever means having a lower end pivotally mounting said mid-portion of said front bogie support member, having an upper end, and having an intermediate portion, rear pivoted lever means inclined downward in a direction opposite to said front lever means, said rear lever means having a lower end pivotally mounting said mid-portion of said rear bogie support member, having an upper end, and having an intermediate portion, means pivotally mounting said intermediate portion of said front lever means to the external surfaces of said first and second parallel side wall members at a first fixed position vertically below said toe, means pivotally mounting said intermediate portion of said rear lever means to the external surfaces of said first and second parallel side wall members at a second fixed position vertically below said heel, front shock absorbing means operating between said upper end of said front lever means and the internal surfaces of said first and second side wall members, and rear shock absorbing means operating between said upper end of said rear lever means and the internal surfaces of said first and second side wall members.

25. The in-line roller skate of claim 24 wherein said front shock absorbing means comprises coiled compression spring means having a coiled length that is compressed between said upper end said front lever means and said internal surfaces of first and second side wall members, wherein said rear front shock absorbing means comprises rear coiled compression spring means having a coiled length that is compressed between said upper end of said rear lever means and attachment to said internal surfaces of said first and second side wall members, including;

front and rear manually adjustable stop means associated with said upper ends of said front and rear lever means, respectively, said front and rear stop means operating to restrict movement of said upper ends of said front and rear lever means, respectively, as said front and rear coiled spring means assume a generally uncompressed state, said front and rear stop means facilitate selective use of front and rear coiled compression springs of variable coil length in accordance with selective manual adjustment of said front and rear stop means.

26. The in-line roller skate of claim 25, including;

a manually adjustable brake pad mounted horizontally between said first and second side wall members at a position that is vertically intermediate said sole and said fourth wheel, said fourth wheel normally being out of physical engagement with said brake pad, and said fourth wheel being movable into physical engagement with said brake pad upon elevation of said toe, and manual adjustment means for said brake pad facilitating selective vertical adjustment of said brake pad relative to said fourth wheel.

27. The in-line roller skate of claim 24 wherein the distance from said lower end of said front and rear lever means to said intermediate portion and the distance from said upper end of said front and rear lever means to said intermediate portion have a length ratio in the range of from about 1.3-to-1 to about 1.9-to-1.

28. The in-line roller skate of claim 27 wherein the length of each of said front and rear lever means is about 4.0 inches, wherein said wheels are of equal radius, and wherein vertical upward movement of said front and rear bogies toward said sole is about 80% of said wheel radius.

29. The in-line roller skate of claim 28 wherein, said front and rear lever means form an angle of about 27 degrees to said sole when said front and rear shock absorber means are not subjected to a shock, said front and rear lever means form and angle of about 13 degrees to said sole when said front and rear shock absorber means are subjected to a shock that is about mid-range of the ability of said shock absorbing means to absorb a shock, and said front and rear lever means form and angle about zero degrees to said sole when said front and rear shock absorber means are subjected to a shock that is about full-range of the ability of said shock absorbing means to absorb a shock.

30. The in-line roller skate of claim 29 wherein;

the length of said support member of each of said front and rear bogies is about 4 inches.

31. An in-line roller skate adapted to move in a travel direction relative to a generally horizontal skating surface, comprising;

a skate shoe having a sole, a heel and a toe, first and second elongated and parallel side wall members extending vertically downward from said sole, said first and second wall members being horizontally spaced apart and extending in said forward direction, said first and second wall members each having an internal surface and an external surface, said internal surfaces of said first and second wall members facing each other and being horizontally spaced apart, a front bogie having a support member having a front portion supporting a first wheel, having a rear portion supporting a second wheel, and having a mid-portion, a rear bogie having a support member having a front portion supporting a third wheel, having a rear portion supporting a fourth wheel, and having a mid-portion, front pivoted lever means inclined downward in said forward direction, said front lever means having a lower end pivotally mounting said mid-portion of said front bogie support member, having an upper end that is bent upward a given angle out of alignment with said lower end, and having an intermediate portion, a rear pivoted lever means inclined downward in a direction opposite to said front lever means, said rear lever means having a lower end pivotally mounting said mid-portion of said rear bogie support member, having an upper end bent upward at said given angle out of alignment with said lower end, and having an intermediate portion, means pivotally mounting said intermediate portion of said front lever means to the external surfaces of said first and second parallel side wall members at a first fixed position vertically below said toe, means pivotally mounting said intermediate portion of said rear lever means to the external surfaces of said first and second parallel side wall members at a second fixed position vertically below said heel, said first fixed position of pivotal mounting being in horizontal alignment with said second fixed position of pivotal alignment, front shock absorbing means operating between said upper end of said front lever means and the internal surfaces of said first and second side wall members, and rear shock absorbing means operating between said upper end of said rear lever means and the internal surfaces of said first and second side wall members.

32. The in-line roller skate of claim 31 wherein said front shock absorbing means comprises coiled compression spring means having a coiled length that is compressed between said upper end said front lever means and said internal surfaces of first and second side wall members, and wherein said rear front shock absorbing means comprises rear coiled compression spring means having a coiled length that is compressed between said upper end of said rear lever means and attachment to said internal surfaces of said first and second side wall members.

33. The in-line roller skate of claim 31, including;

a manually adjustable brake pad mounted horizontally between said first and second side wall members at a position that is vertically intermediate said sole and said fourth wheel, said fourth wheel normally being out of physical engagement with said brake pad, and said fourth wheel being movable into physical engagement with said brake pad upon elevation of said toe, and manual adjustment means for said brake pad facilitating selective vertical adjustment of said brake pad relative to said fourth wheel.

34. The in-line roller skate of claim 31 wherein the distance from said lower end of said front and rear lever means to said intermediate portion and the distance from said upper end of said front and rear lever means to said intermediate portion have a length ratio in the range of from about 1.3-to-1 to about 1.9-to-1.

35. The in-line roller skate of claim 34 wherein the length of each of said front and rear lever means is about 4.0 inches, wherein said wheels are of equal radius, and wherein vertical upward movement of said front and rear bogies toward said sole is about 80% of said wheel radius.

* * * * *